US005762046A

United States Patent [19]

Holmes et al.

[11] Patent Number: 5,762,046

[45] Date of Patent: Jun. 9, 1998

[54] DUAL SPEED FUEL DELIVERY SYSTEM

[75] Inventors: John William Holmes, Eastpointe; Mariann E. Bischoff, Dearborn; Christopher Arnold Woodring, Canton, all of Mich.

[73] Assignee: Ford Global Technologies, Inc., Dearborn, Mich.

[21] Appl. No.: 795,742

[22] Filed: Feb. 6, 1997

[51] Int. Cl.[6] ..... F02M 37/04

[52] U.S. Cl. ..... 123/497; 417/45

[58] Field of Search ..... 123/495, 497; 417/45, 44.2; 318/806

[56] References Cited

U.S. PATENT DOCUMENTS

| | | | |
|---|---|---|---|
| 4,430,980 | 2/1984 | Pidgeon | 123/497 |
| 4,791,905 | 12/1988 | Furuta et al. | 123/497 |
| 4,940,034 | 7/1990 | Heim et al. | 123/497 |
| 5,207,199 | 5/1993 | Sekiguchi | 123/357 |
| 5,237,975 | 8/1993 | Betki et al. | 123/497 |
| 5,291,578 | 3/1994 | Kalami | 123/497 |
| 5,313,923 | 5/1994 | Takeuchi et al. | 123/497 |
| 5,325,836 | 7/1994 | Orzel et al. | 123/478 |
| 5,377,651 | 1/1995 | Sczomak et al. | 123/569 |
| 5,379,741 | 1/1995 | Matysiewicz et al. | 123/497 |
| 5,456,234 | 10/1995 | Kodama et al. | 123/497 |
| 5,505,180 | 4/1996 | Otterman et al. | 123/497 |
| 5,579,738 | 12/1996 | Frischmuth et al. | 123/497 |
| 5,609,140 | 3/1997 | Krammer et al. | 123/497 |

*Primary Examiner*—Thomas N. Moulis
*Attorney, Agent, or Firm*—Neil P. Ferraro

[57] ABSTRACT

A dual speed fuel delivery system for an internal combustion engine in an automotive vehicle includes a fuel pump, a dropping resistor connected to the fuel pump for reducing the voltage required to drive the fuel pump, and a controller for determining an optimum transition point between one of a relatively high and low speed fuel pump operation so that a controlled amount of fuel is delivered to the engine. The controller calculates fuel pressure increase across the fuel pump, determines the minimum fuel pump voltage necessary to drive the fuel pump such that a predetermined amount of fuel is supplied to the engine and determines the current draw of the fuel pump. The controller then calculates the voltage drop across the dropping resistor and compares the resulting voltage with the minimum fuel pump voltage. The controller then selectively by-passes the dropping resistor based on this comparison.

12 Claims, 3 Drawing Sheets

DUAL SPEED FUEL DELIVERY SYSTEM

FIELD OF THE INVENTION

This invention relates to dual speed fuel delivery systems for automotive internal combustion engines, and in particular, to dual speed fuel pump control in such fuel delivery systems.

BACKGROUND OF THE INVENTION

Conventional fuel delivery systems for internal combustion engines typically include a fuel pump which runs at a constant speed and supplies a constant quantity of fuel to the engine. Because engine fuel requirements vary widely with operating conditions, much of the fuel supplied is not actually needed by the engine and must be returned to the fuel tank. The fuel pump operates at maximum speed all of the time, which adversely affects pump durability. In addition, a higher electrical demand is placed on the electrical system to continually operate the fuel pump at a maximum delivery rate.

Dual speed fuel systems have been developed to address some of these concerns. These systems typically include dual speed fuel pump control logic that is responsive solely to engine operating characteristics, such as mass air flow and engine speed, to determine the quantity of fuel to be delivered to the engine and subsequently to determine the operating speed of the fuel pump. However, these systems are not responsive to parameters that directly affect the fuel pump, such as fuel pressure, fuel flow, voltage and current.

The inventors of the present invention have found certain disadvantages with these prior art systems. For example, because these prior art systems respond solely to engine operating characteristics, a relatively rough estimate of the proper quantity of fuel to be delivered to the engine is calculated. As a result, these systems typically cause the fuel pump to default to a high speed or full power operating mode that results in a higher than necessary fuel delivery rate. In fact, in known prior art systems, the pump would only operate at low speed or reduced power when the engine is at or near idle. However, the inventors of the present invention have determined that high speed fuel pump operation is generally required only during heavy acceleration or hill climbing.

SUMMARY OF THE INVENTION

An object of the present invention is to provide a relatively precise estimate of fuel delivered to the engine. This object is achieved, and disadvantages of prior art approaches are overcome by providing a novel dual speed fuel delivery system for an internal combustion engine in an automotive vehicle. The system includes an electric motor driven fuel pump coupled to a power supply for delivering fuel to the engine, a dropping resistor connected in series between the fuel pump and the power supply for reducing the voltage required to drive the fuel pump, and a controller for determining an optimum transition point between a relatively high and low speed fuel pump operation so that a controlled amount of fuel is delivered to the engine.

The controller calculates fuel pressure increase across the fuel pump, determines the minimum fuel pump voltage necessary to drive the fuel pump such that a predetermined amount of fuel is supplied to the engine and determines the current draw of the fuel pump based on the fuel pressure increase and the minimum fuel pump voltage. The predetermined amount of fuel corresponds to a calculated amount of fuel that will be consumed by the engine during a given time.

The controller assumes that the dropping resistor is in the circuit and subsequently calculates the voltage drop across the dropping resistor to determine the voltage available at the pump. This voltage is compared with the minimum fuel pump voltage. The controller then selectively by-passes the dropping resistor based on this comparison. That is, if the voltage available at the pump is less than the minimum voltage, then the dropping resistor is by-passed such that the pump operates at high speed. If, on the other hand, the voltage available at the pump is greater than the minimum voltage, the dropping resistor remains in the circuit such that the pump operates at low speed.

The system may also include a hysteresis whereby the optimum transition point between relatively high and low speed fuel pump operation depends upon the present speed of the fuel pump.

Further, the controller may sense engine temperature, compare this sensed temperature with a predetermined threshold temperature, and determine whether this sensed temperature is above or below the predetermined threshold temperature. The controller then operates the fuel pump at the relatively high speed when the sensed temperature is below the predetermined threshold temperature.

An advantage of the present invention is that a that fuel pump durability is increased.

Another advantage of the present invention is that less energy is required to operate the pump, thereby having the attendant benefit of increasing fuel economy.

Yet another advantage of the present invention is that a minimum amount of fuel is returned to the fuel tank, thereby reducing the load on the vapor recovery system.

Other objects, features and advantages of the present invention will be readily appreciated by the reader of this specification.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
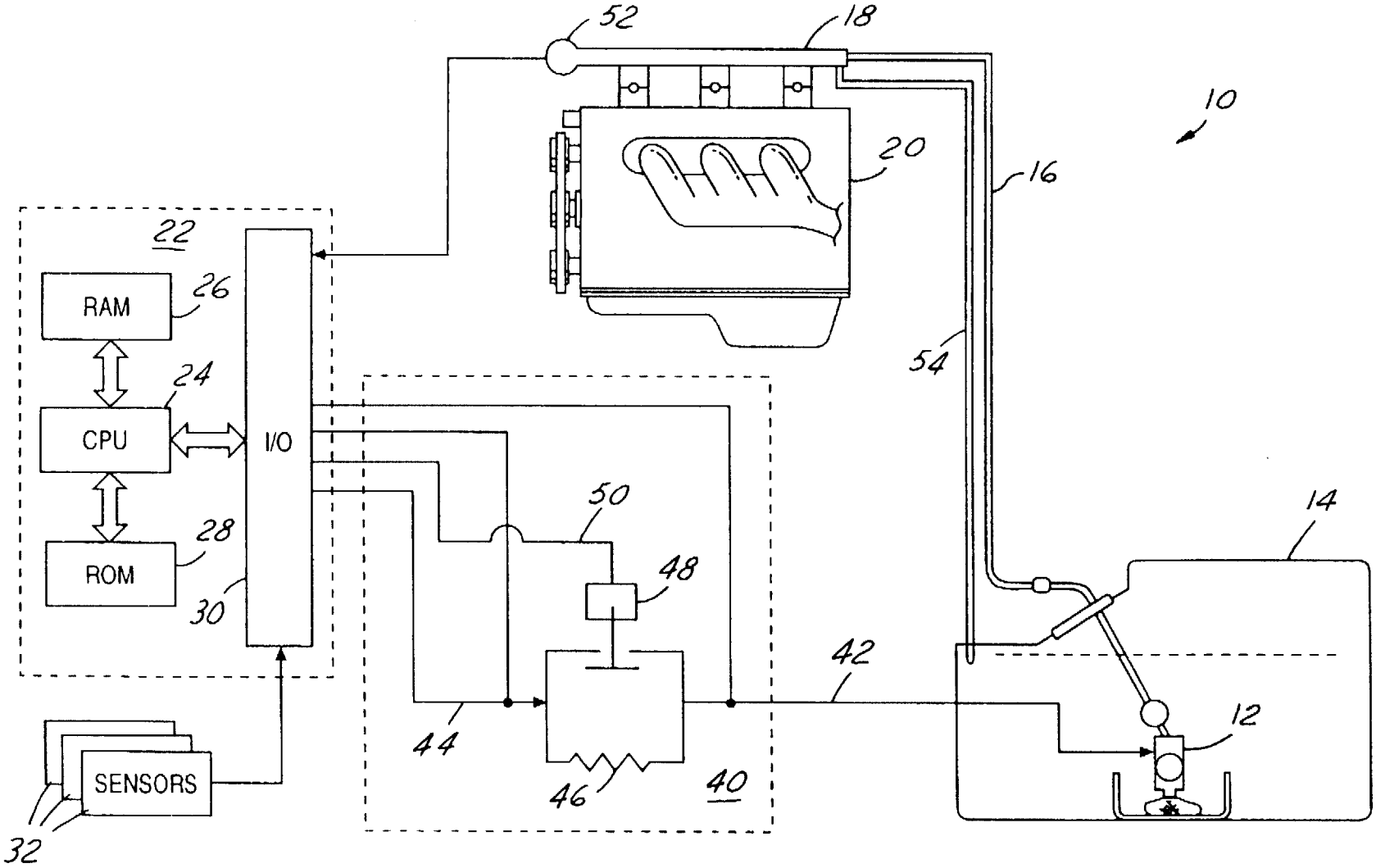
FIG. 1 is a schematic representation of a dual speed fuel delivery system according to the present invention.

Dual speed fuel delivery system 10 includes electric motor driven fuel pump 12 mounted inside of fuel tank 14 for delivering fuel through fuel line 16 to fuel rail 18 of engine 20. System 10 also includes controller (computer) 22, which may comprise a conventional engine control microprocessor known to those skilled in the art, or a stand-alone processor, as desired. Controller 22 includes CPU 24, random access memory (RAM) 26, computer storage medium (ROM) 28 having a computer readable code encoded therein, which is an electronically programmable chip in this example, and input/output (I/O) bus 30. The computer program encoded in computer storage medium 28 causes controller 22 to control the supply voltage to fuel pump 12, as will be further explained hereinafter. A plurality of sensors 32 senses numerous operating characteristics, including mass air flow or engine manifold vacuum, engine temperature, power supply voltage and other characteristics known to those skilled in the art and suggested by this disclosure.

Continuing with reference to FIG. 1, system 10 also includes control circuit 40 connected between fuel pump lead 42 and power supply lead 44. Control circuit 40 includes bypass dropping resistor 46 and relay 48, which is controlled by controller 22 through control line 50.

According to the present invention, computer storage medium 28 stores a plurality of fuel pump operating characteristics. These operating characteristics include the optimum fuel pressure increase across fuel pump 12, the optimum fuel flow through the fuel pump 12, and the corresponding optimum or minimum fuel pump voltage necessary to drive fuel pump 12 such that a predetermined amount of fuel is supplied to engine 20 and the corresponding current draw of fuel pump 12. As used herein, the predetermined amount of fuel corresponds to a calculated amount of fuel that will be consumed by engine 20 during a given time period. These optimum values are determined from bench testing for a specific engine configuration and are subsequently stored in computer storage medium 28. Controller 22 utilizes this information to determine an optimum fuel pump speed or an optimum transition point between relatively high and low fuel pump speeds as will be further described hereinafter.

Figure 2:
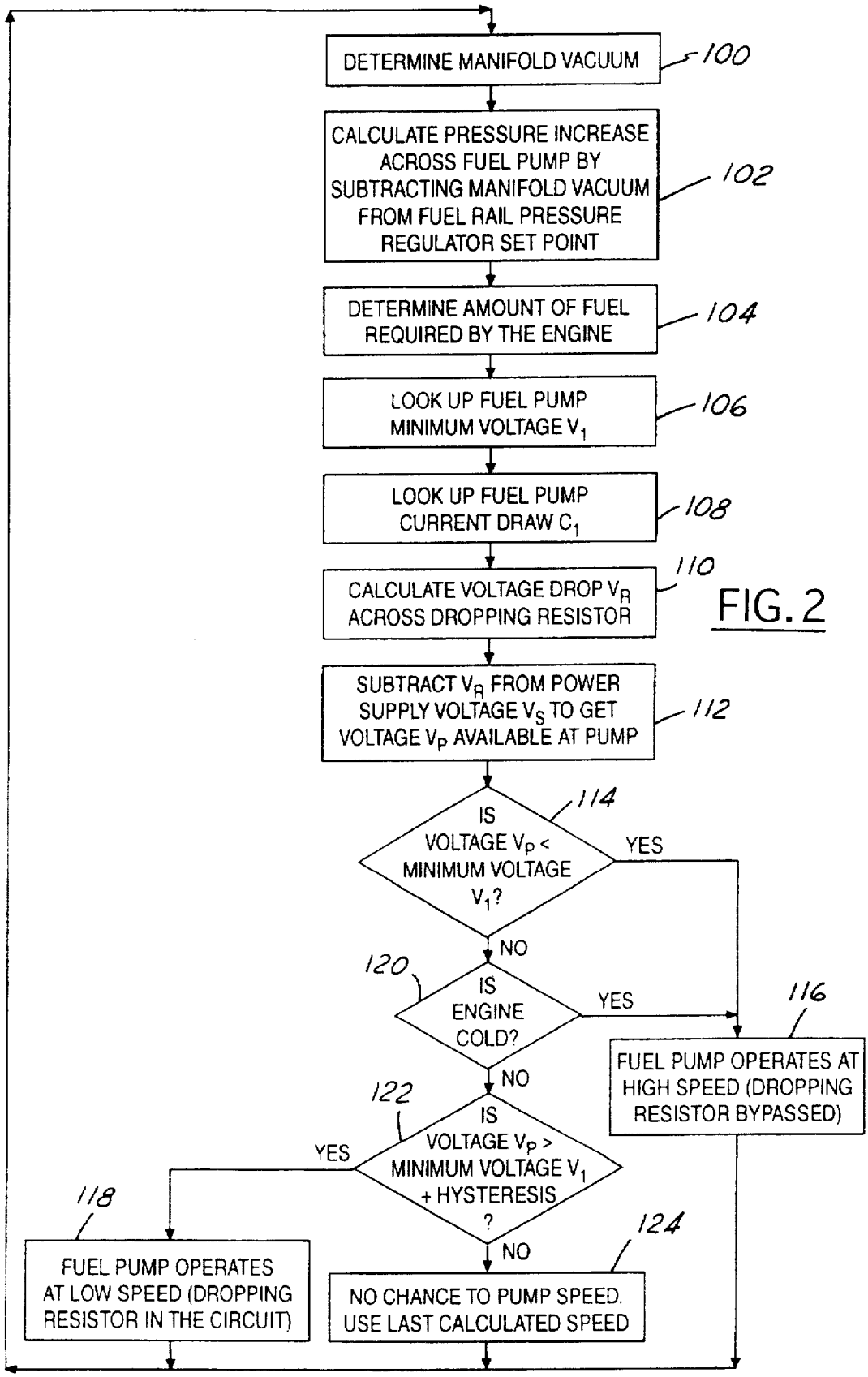
FIG. 2 is a flow chart showing the operation of a dual speed fuel delivery system according to the present invention; and, FIGS. 3 and 4 are tables stored in the memory of a controller of a dual speed fuel delivery system according to the present invention.
Figure 3:
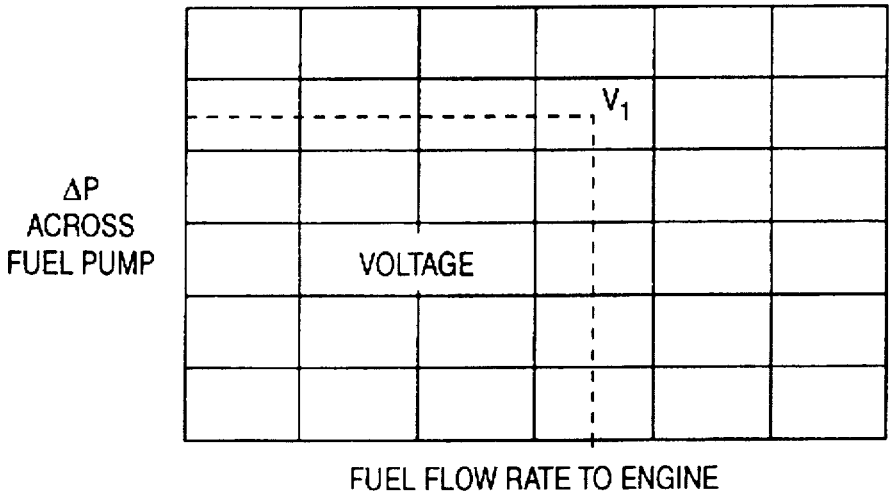
Figure 4:
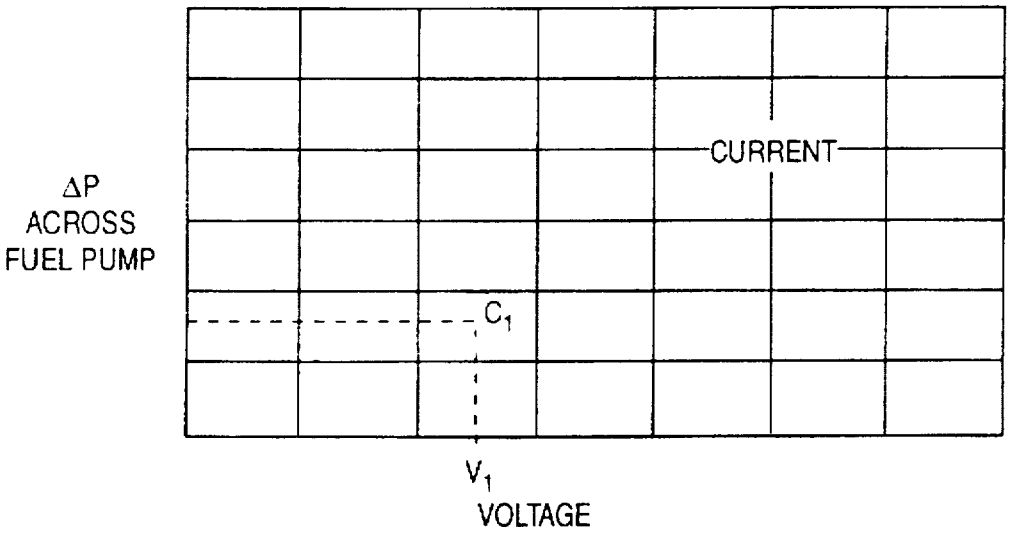

Turning now to FIGS. 2–4, operation of dual speed fuel delivery system 10 will now be described in detail. Controller 22 senses engine manifold vacuum through one of sensors 32, shown at Step 100 in FIG. 2. Alternatively, engine manifold vacuum may be inferred from sensed mass air flow. At Step 102, controller 22 calculates the pressure increase across fuel pump 12. Computer storage medium 28 also stores the pressure regulator set point of the pressure regulator 52 mounted on fuel rail 18 (see FIG. 1). With the manifold vacuum known and the pressure regulator set point known, computer 22 calculates the pressure difference (increase) across fuel pump 12. Of course, those skilled in the art will recognize in view of this disclosure that rather than having the pressure regulator set point stored in computer storage medium 28, controller 22 may sense the pressure increase in fuel line 16 through one of sensors 32.

Next, at Step 104, controller 22 determines the amount of fuel (fuel flow) required by the engine based on sensed mass air flow and a given air/fuel ratio as stored in computer storage medium 28. This amount of fuel corresponds to the amount of fuel that will be consumed by the engine at a given time. At Step 106, with the known pressure increase across fuel pump 12 and the known fuel flow, controller 22 retrieves the minimum voltage $V_1$ from the table shown in FIG. 3, which is stored in computer storage medium 28. This voltage $V_1$ represents the voltage necessary to drive fuel pump 12 at a given flow rate (as determined in Step 104) and pressure increase (as determined in Step 102) such that the amount of fuel required by the engine is delivered with limited fuel returned to the fuel tank 14 through return line 54 (see FIG. 1). With the known minimum voltage $V_1$ and the pressure increase across fuel pump 12, at Step 108, controller 22 retrieves the corresponding current draw $C_1$ from the table shown in FIG. 4, which is also stored in computer storage medium 28.

At Step 110, controller 22 calculates the voltage drop $V_R$ across dropping resistor 46. With the known current draw $C_1$ and the known resistance through dropping resistor 46, and any resistance through lines 44 and 42, controller 22 calculates the voltage drop $V_R$. At Step 112, controller 22 determines the voltage $V_P$ available at fuel pump 12. That is, the voltage drop across the resistor $V_R$ is subtracted from the power supply voltage $V_S$, which may change due to varying vehicle operating conditions, to determine the voltage $V_P$ at fuel pump lead 42.

Continuing with reference to FIGS. 2–4, according to the present invention, at Step 114, controller 22 determines the optimum transition point between relatively high and low speed operation by comparing the voltage $V_P$ available at pump 12 with the minimum voltage $V_1$. If the voltage $V_P$ available at pump 12 is less than the minimum voltage $V_1$, controller 22 signals relay 50 (see FIG. 1) to close such that dropping resistor 46 is bypassed. As a result, full power supply voltage $V_S$ is applied to fuel pump 12 thereby causing the fuel pump to operate at a relatively high speed (full power) and subsequently delivering a relatively high fuel flow rate. If, on the other hand, the voltage $V_P$ available at the pump is greater than the minimum voltage $V_1$, then suffice it to say for now, fuel pump 12 operates at a relatively low speed (reduced power), thereby delivering a relatively low fuel flow rate. That is, controller 22 signals relay 50 to open such that the dropping resistor 46 remains in the circuit (i.e., not bypassed), thereby causing the voltage at fuel pump lead 42 (voltage $V_P$ available at pump 12) to be less than the voltage at line power supply lead 44 (supply voltage $V_S$).

In a preferred embodiment, controller 22 senses engine temperature through one of the sensors 32. At Step 120, controller 22 determines whether engine 20 is cold or warm, that is, whether the engine temperature is above or below a predetermined threshold level as stored in computer storage medium 28. If controller 22 determines that engine 20 is cold, because a greater amount of fuel is required by the engine, then the dropping resistor 46 is bypassed and fuel pump 12 operates at a relatively high speed, as shown in Step 116. If, on the other hand, engine 20 is warm, at Step 122, controller 22 determines whether the voltage $V_P$ available at pump 12 is greater than the minimum voltage $V_1$ plus a hysteresis. Thus, if the voltage $V_P$ available at the pump is less than the minimum voltage $V_1$ plus the hysteresis, then the speed of pump 12 is not changed, as shown at Step 124.

According to the present invention, the optimum transition point between relatively high and low operating speeds of fuel pump 12, as determined by controller 22, depends upon the present speed of fuel pump 12. Thus, for example, when fuel pump 12 is operating at a relatively low speed, as determined by controller 22, the optimum transition point occurs at a point that is different from that when the fuel pump is operating at a relatively high speed. This creates the desired hysteresis, which aids in preventing fuel pump 12 from continually switching between relatively high and low speeds as well as preventing relay 50 from continually actuating when fuel pump 12 is operating near the transition point. This phenomenon is known as "hunting", which the hysteresis is designed to overcome.

Because the engine operating conditions continually change, the process of determining whether to operate the pump at the high or low speed continues. That is, a shown in FIG. 2, the process returns to Step 100 with the controller 22 determining the manifold vacuum.

While the best mode for carrying out the invention has been described in detail, those skilled in the art in which this invention relates will recognize various alternative designs and embodiments, including those mentioned above, in practicing the invention that has been defined by the following claims.

We claim:

1. A dual speed fuel delivery system for an internal combustion engine in an automotive vehicle comprising:

an electric motor driven fuel pump coupled to a power supply for delivering fuel to the engine;

a dropping resistor connected in series between said fuel pump and said power supply for reducing the voltage required to drive said fuel pump;

a controller for determining an optimum transition point between one of a relatively high and low speed fuel pump operation so that a controlled amount of fuel is delivered to the engine, with said controller calculating fuel pressure increase across said fuel pump, determining the minimum fuel pump voltage necessary to drive the fuel pump such that a predetermined amount of fuel is supplied to said engine, with said predetermined amount of fuel corresponding to a calculated amount of fuel that will be consumed by the engine during a given time, determining the current draw of the fuel pump based on said fuel pressure increase and said minimum fuel pump voltage, calculating the voltage drop across said dropping resistor, determining the voltage available at said pump, comparing the voltage available at said pump with said minimum fuel pump voltage, and, selectively by-passing said dropping resistor based on said comparison.

2. A system according to claim 1 further comprising a relay connected in parallel with said dropping resistor, with said controller controlling said relay such that said dropping resistor is selectively by-passed.

3. A system according to claim 1 wherein said optimum transition point is different depending upon whether said pump is presently operating in one of said relatively high and low speeds so as to form a hysteresis.

4. A system according to claim 1 wherein said controller senses engine temperature, compares said sensed temperature with a predetermined threshold temperature, determines whether said sensed temperature is one of above or below said predetermined threshold temperature, and, operates said fuel pump at a relatively high speed when said sensed temperature is below said predetermined threshold temperature.

5. A method of controlling fuel delivery to an internal combustion engine in an automotive vehicle, with the vehicle having an electric motor driven fuel pump coupled to a power supply for delivering fuel to said engine, with said method comprising the steps of:

calculating fuel pressure increase across said fuel pump;

determining the minimum fuel pump voltage necessary to drive the fuel pump such that a predetermined amount of fuel is supplied to said engine, with said predetermined amount of fuel corresponding to a calculated amount of fuel that will be consumed by the engine during a given time;

determining the current draw of the fuel pump based on said fuel pressure increase and said minimum fuel pump voltage;

connecting a dropping resistor in series between said fuel pump and said pump power supply;

calculating the voltage drop across said dropping resistor;

determining the voltage available at said pump;

comparing the voltage available at said pump with said minimum fuel pump voltage; and, selectively by-passing said dropping resistor based on said comparison such that said fuel pump may operate at one of a relatively high and low speed operation.

6. A method according to claim 5 further comprising the steps of:

determining an optimum transition point between said relatively high and low speeds; and, determining a different optimum transition point depending upon whether said pump is presently operating in one of said relatively high and low speeds so as to form a hysteresis.

7. A method according to claim 5 further comprising the steps of:

sensing engine temperature;

comparing said sensed temperature with a predetermined threshold temperature;

determining whether said sensed temperature is one of above or below said predetermined threshold temperature; and, operating said fuel pump at a relatively high speed when said sensed temperature is below said predetermined threshold temperature.

8. An article of manufacture comprising:

a computer storage medium having a computer program encoded therein for causing a computer to control an electric motor driven fuel pump coupled to a power supply in a dual speed fuel delivery system of an automotive internal combustion engine, with said dual speed fuel delivery system having a dropping resistor connected in series between said fuel pump and said power supply, with said computer storage medium comprising:

a computer readable program code means for causing said computer to calculate fuel pressure increase across said fuel pump;

a computer readable program code means for causing said computer to determine the minimum fuel pump voltage necessary to drive the fuel pump such that a predetermined amount of fuel is supplied to said engine, with said predetermined amount of fuel corresponding to a calculated amount of fuel that will be consumed by the engine at a given time;

a computer readable program code means for causing said computer to determine the current draw of said fuel pump based on said fuel pressure increase and said minimum fuel pump voltage;

a computer readable program code means for causing said computer to calculate the voltage drop across said dropping resistor;

a computer readable program code means for causing said computer to determine the voltage available at said pump;

a computer readable program code means for causing said computer to compare said voltage available at said pump with said minimum fuel pump voltage; and, a computer readable program code means for causing said computer to selectively by-pass said dropping resistor based on said comparison such that said fuel pump may operate at one of a relatively high and low speed operation.

9. An article of manufacture according to claim 8 wherein said computer storage medium further comprises:

a computer readable program code means for causing said computer to determine an optimum transition point between said relatively high and low speeds; and, a computer readable program code means for causing said computer to determine a different optimum transition point depending upon whether said pump is currently operating in one of said relatively high and low speeds so as to form a hysteresis.

10. An article of manufacture according to claim 8 wherein said computer storage medium further comprises:

a computer readable program code means for causing said computer to sense engine temperature;

a computer readable program code means for causing said computer to compare said sensed temperature with a predetermined threshold temperature;

a computer readable program code means for causing said computer to determine whether said sensed temperature is one of above or below said predetermined threshold temperature; and, a computer readable program code means for causing said computer to operate said fuel pump at a relatively high speed when said sensed temperature is below said predetermined threshold temperature.

11. An article of manufacture according to claim 9 wherein said computer storage medium comprises an electronically programmable chip.

12. An article of manufacture according to claim 10 wherein said computer storage medium comprises an electronically programmable chip.

* * * * *